US006454262B1

(12) United States Patent
Wilt et al.

(10) Patent No.: US 6,454,262 B1
(45) Date of Patent: Sep. 24, 2002

(54) AUTOMOBILE LICENSE PLATE GAME AND METHOD OF PLAY

(76) Inventors: Carol Vander Wilt, 656 Locust St., Winnetka, IL (US) 60093; Carl Vander Wilt, 656 Locust St., Winnetka, IL (US) 60093

( * ) Notice: Subject to any disclaimer, the term of this patent is extended or adjusted under 35 U.S.C. 154(b) by 35 days.

(21) Appl. No.: 09/648,149

(22) Filed: Aug. 25, 2000

Related U.S. Application Data

(60) Provisional application No. 60/150,745, filed on Aug. 25, 1999.

(51) Int. Cl.[7] ..... A63F 3/00

(52) U.S. Cl. ..... 273/243; 273/272; 273/299; 273/240; 463/9

(58) Field of Search ..... 273/243, 272, 273/273, 236, 244.2

(56) References Cited

U.S. PATENT DOCUMENTS 4,383,689 A * 5/1983 Kohner et al. ..... 273/145 R
4,884,815 A * 12/1989 Glenn ..... 273/240
5,056,798 A * 10/1991 Wehrley ..... 273/460
5,149,103 A * 9/1992 Ross ..... 273/432
5,207,435 A * 5/1993 Tanner ..... 273/429
5,219,291 A * 6/1993 Fong et al. ..... 434/323
5,308,077 A * 5/1994 Caggiano ..... 273/243
5,505,456 A * 4/1996 Schmidt ..... 273/272
5,544,891 A 8/1996 Gibson et al.
5,586,765 A * 12/1996 Lackey ..... 273/299
5,788,238 A * 8/1998 LeBriton et al. ..... 273/272
5,921,864 A * 7/1999 Walker et al. ..... 463/9

* cited by examiner

*Primary Examiner*—Benjamin H. Layno
*Assistant Examiner*—Dolores R. Collins
(74) *Attorney, Agent, or Firm*—Lee, Mann, Smith McWilliams, Sweeney and Ohlson

(57) ABSTRACT

An alphanumeric character scramble game played by two or more players utilizing a set of cards each having imprinted thereon a scrambled alphanumeric character string in the form of an automobile license plate. When unscrambled the alphanumeric character string phonetically or representatively corresponds to a word or phrase written answer. Clues are given to the players during each round of play. Points are awarded to a player who answers correctly and subtracted for incorrect answers. A player wins when his or her score reaches a pre-determined value.

12 Claims, 2 Drawing Sheets

AUTOMOBILE LICENSE PLATE GAME AND METHOD OF PLAY

This application claims priority from provisional application No. 60/150,745 filed on Aug. 25, 1999

BACKGROUND OF THE INVENTION

The present invention relates to word games and in particular to an alphanumeric scramble game utilizing a set of cards each having imprinted thereon a scrambled alphanumeric character string in the form of an automobile license plate. When unscrambled, the alphanumeric character string phonetically or representatively corresponds to a word or phrase, much like the alphanumeric characters printed on a typical customized automobile license plate. i.e. vanity plate.

The prior art includes many types of games involving word scrambling and forming wherein players attempt to create known words from a scrambled letter string. Typically these games involve clues or phrases that are given to the player to aid in solving for the word answer. These games typically improve vocabulary and spelling skills of the players. However. none of these prior art games involve solving for an alphanumeric character string that phonetically or representatively corresponds to a word or phrase, as opposed to the spelling of a word or phrase.

It is therefore an object of the present invention to provide a challenging and thought-provoking game that involves the unscrambling of an alphanumeric character string in order to determine another alphanumeric character string that phonetically or representatively corresponds to a word or phrase.

It is another object of the present invention to provide an educational game that enhances and improves the phonetic and vocabulary skills of the players.

It is a further object of the present invention to provide a game that requires solving for an alphanumeric character string in the form of a character string printed on a customized automobile license plate, which adds further excitement and interest to the game.

These and other objects of the invention will become apparent after review of the specification and drawings.

SUMMARY OF THE INVENTION

The present invention is a game played between a starter and one or more players that requires the players to unscramble a given alphanumeric character string and determine a word or phrase written answer in the form of a second alphanumeric character string that phonetically or representatively corresponds to that word or phrase answer. The given character string is imprinted on a card that resembles an automobile license plate. The game includes a set of these cards. each having a different character string. Clues are also imprinted on the cards and are given to the players in order to help them determine the word or phrase written answer that corresponds to the unscrambled character string. Each clue includes a number or letter of the unscrambled character string. There is a prescribed time limit in which to offer a response after each clue is given. There is also a prescribed number of clues for each card.

After the first clue is given. a player may respond within the time limit. If the player's response is incorrect, a point is subtracted from that player's point total and the game proceeds to a second clue. If the player's response is correct. the player is awarded points corresponding to the number of clues required to correctly solve for the word or phrase answer multiplied by bonus points determined by the roll of a die. When a correct response is offered, or when none of the players offer a correct response within the time limit after the final clue is given, the round is over and the person on the starter's left serves as the starter for the second round. A number of rounds are played until a player reaches a prescribed point total. The first player to reach the prescribed point total is the inner of the game.

DETAILED DESCRIPTION OF THE INVENTION

While the present invention will be described fully hereinafter with reference to the accompanying drawings in which a particular embodiment is shown, it is to be understood at the outset that persons skilled in the art may modify the invention herein described while still achieving the desired result of this invention. Accordingly. the description which follows is to be understood as a broad informative disclosure directed to persons skilled in the appropriate arts ands not as limitations of the present invention.

Figure 1:
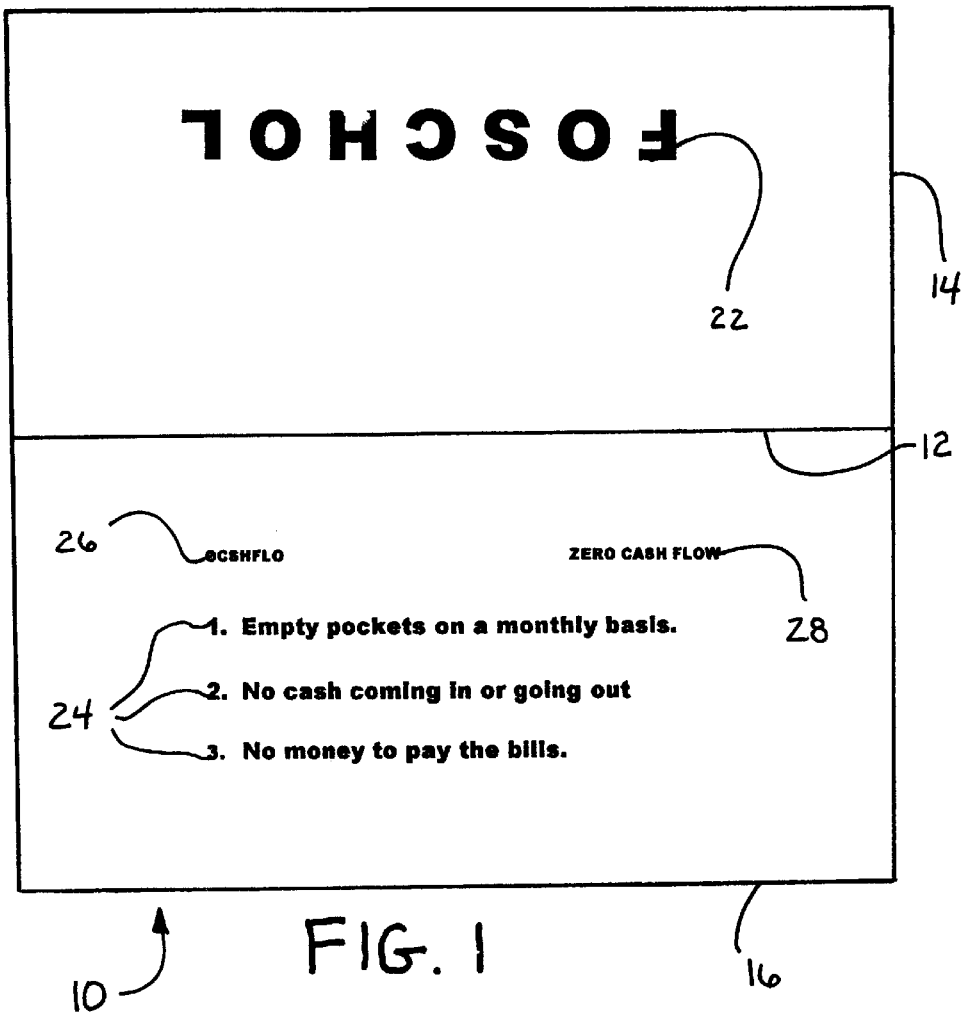
FIG. 1 is a top plan view of a representative display card having a fold line and printed indicia on each side of the fold line illustrative of sample clues and answer.
Figure 2:
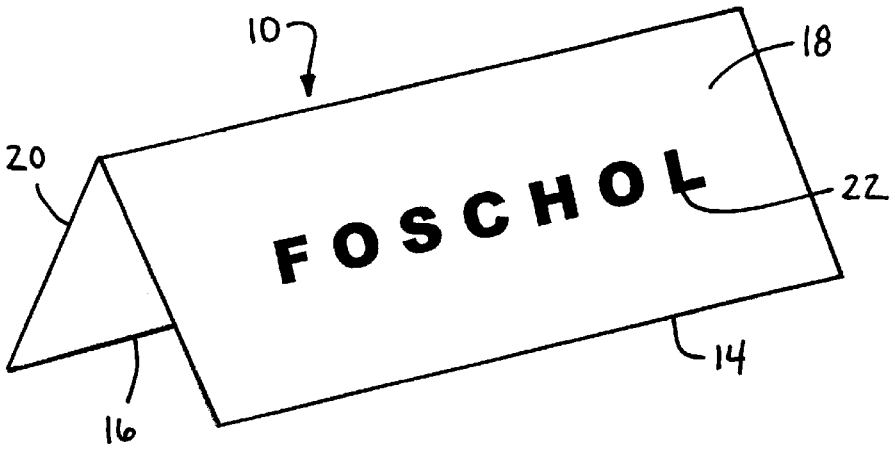
FIG. 2 is a perspective view of the display card folded along the fold line and defining a front and back surface of the display card.

The present invention is a game that utilizes a set of display cards 10. One display card 10 is shown in FIGS. 1 and 2. The display card 10 has a fold line 12 in the middle of the display card 10 and edges 14 and 16. The card is folded along the fold line 12 to allow the display card 10 to be stood on edges 14 and 16 for display during play of the game, thus defining a front side 18 and a back side 20 of the display card 10, as shown in FIG. 2. A scrambled alphanumeric character string 22 is imprinted on the front side 18 of the display card 10. In a preferred embodiment. the front side 18 of the display card 10 is configured to look like an automobile license plate. with the scrambled character string 22 being the license plate number. Thus, the scrambled character string 22 would appear as if it was printed on an automobile vanity license plate. Three clues 24, an unscrambled character string 26 and a written answer 28 are imprinted on the back side 20 of the display card 10. The written answer 28 is in the form of a word or phrase. Each of the display cards 10 of the set have different scrambled alphanumeric character strings 22, clues 24, unscrambled character strings 26 and written answers 28 printed thereon.

Figure 3:
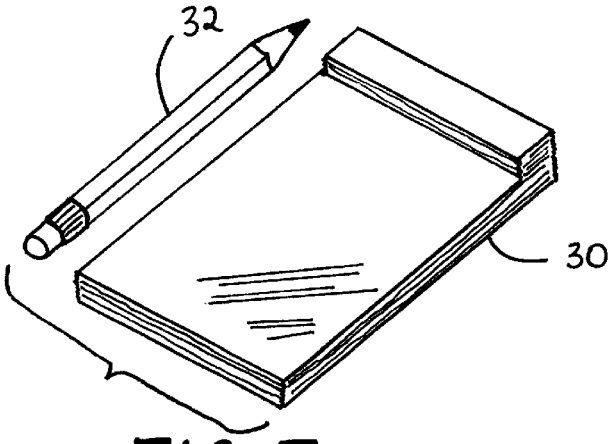
FIG. 3 is a composite perspective view of a pad of paper and a writing utensil.
Figure 5:
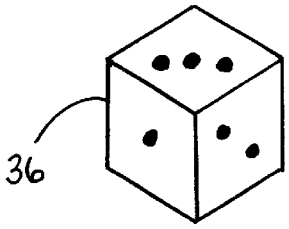
FIG. 5 is a perspective view of a die.
Figure 4:
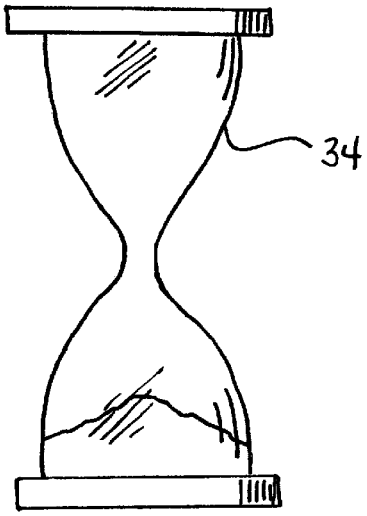
FIG. 4 is a perspective view of a timing device.
Figure 6:
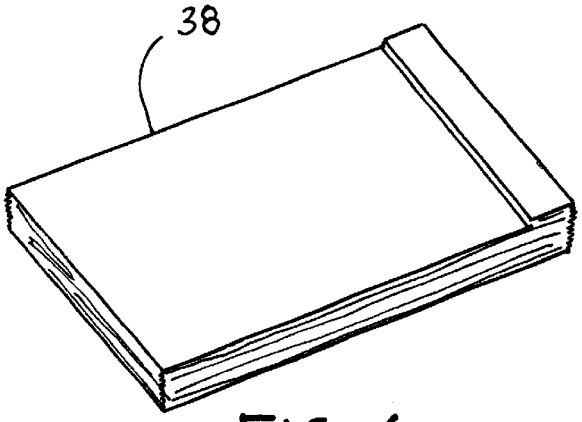
FIG. 6 is a perspective view of a pad of paper for keeping score of points in the game.

Other equipment that is used for playing the game include unscrambling pads of paper and writing utensils 32, as shown in FIG. 3. a timing device 34. as shown in FIG. 4, a die 36, as shown in FIG. 5, and a scoring pad of paper 38, as shown in FIG. 6. In a preferred embodiment of the invention. the writing utensils 32 are not included with the contents of the game and are supplied by the players.

OBJECT OF THE GAME

The object of the game is to accumulate points. The first player to reach the winning point total of fifty points wins the game. However, other point totals can be used to determine the end of the game. Several rounds are played until a player reaches the winning point total. Each round is played utilizing a different display card 10 from the display card set. thus requiring a different solution to the scrambled character string 22.

PLAY

The game is played between a player designated as a starter and one or more other players. Each player rolls the die 36 at the beginning of the game in order to determine who will be the starter for the first round. The player who rolls the highest number on the die 36 is designated as the starter for the first round. The starter keeps in his or her possession the timing device 34, the die 36, and the display cards 10. The players each have in their possession an unscrambling pad of paper 30 and a writing utensil 32 to assist in solving the scrambled alphanumeric character string 22. In a preferred embodiment of the invention, the writing utensil 32 is not included with the contents of the game and is supplied by the players.

Play starts by the starter pulling out a display card 10 and standing it up on its edges 14 and 16 with the front side 18 having the scrambled alphanumeric character string 22 facing the players of the game. The starter immediately reads aloud the first clue of the three clues 24 on the back side 20 of the display card 10 and then starts the timing device 34. The timing device 34 is set to a predetermined amount of time. The first clue includes the first letter or number of the unscrambled character string 26. Likewise, the second and third clues include the second and third letters or numbers of the unscrambled character string 26, respectively. At any time after the clue is read aloud by the starter, a player may offer an answer by stating that he has a solution. The player must then immediately offer the answer aloud. If the player's answer correctly corresponds to the written answer 28 on the back side 20 of the display card 10, then the round of play ends and points are awarded to the player answering correctly. If the player's answer is incorrect, one point is subtracted from that player's point total and the round of play continues with the starter reading aloud the second clue of the three clues 24. Likewise, if no answer is offered by any of the players within the predetermined amount of time, the round of play continues with the second clue.

When the second clue is read, the starter resets the timing device 34 to the predetermined amount of time and immediately starts the timing device 34. Play continues with the second clue in the same fashion as with the first clue. If needed, play continues to the third clue. If no correct answer is given within the predetermined amount of time for the third clue, the round ends and no points are awarded. A new round is started after the previous round ends. At the completion of a round, the timing device 34. the die 36, and the set of display cards 10 are passed to the player on the left side of the starter and that player becomes the starter for the next round. The display card 10 used for the completed round is placed at the back of the set and a new display card 10 is drawn by the new starter. Several rounds are played until the winning point total is reached by one of the players.

A player who answers correctly within the time limit receives points for that round of play. The player who answered correctly rolls the die 36. The number indicated on the die 36 after it is rolled is multiplied by three if the answer was given after one clue and is multiplied by two if the answer was given after two clues. The player receives points equal to the number shown on the die 36 after it is rolled if the answer was given after three clues. The scores for each player is kept on the scoring pad of paper 38, as shown in FIG. 6. Although not shown in FIG. 6, the sheets of paper in the scoring pad 38 can have printed indicia on them to help organize and facilitate score keeping. The game ends when one of the players reaches the winning point total. In a preferred embodiment. the winning point total is fifty points.

While specific embodiments of the present invention have been shown here for the purposes of explaining preferred and alternate embodiments of the invention, it is to be understood that the appended claim has a wide range of equivalents and a broader scope than the embodiments disclosed.

What is claimed is:

1. A method of playing a word game comprising the steps of selecting a group of players;

selecting a starter from the group of selected players;

having the starter randomly select a game piece that contains a scrambled alphanumeric character string. an unscrambled alphanumeric character string, a correct word or phrase answer and three clues;

allowing the group of players to view the scrambled alphanumeric character string; having the starter read out the first clue to the group of players;

initiating a timer for a preselected period of time;

allowing the players to attempt to unscramble the alphanumeric character string into a second alphanumeric character string that phonetically or representatively corresponds to the correct word or phrase answer;

awarding the player who recites the correct word or phrase answer before the end of the preselected time period points;

subtracting one point from the player who recites a word or phrase that is not the answer;

repeating the foregoing steps until a preselected point total of the recorded points is reached by at least one of the players.

2. A method of playing a game as recited in claim 1, wherein: the scrambled alphanumeric character string on the game piece is in the form of an automobile license plate.

3. A method of playing a game as recited in claim 1, wherein:

the game piece is folded so that the scrambled alphanumeric character string is on one half of the game piece and the unscrambled alphanumeric character string, the correct word or phrase answer and three clues are on the other half.

4. A method of playing a game as recited in claim 1, comprising the additional steps of:

rolling of a die by the player who recites the correct word or phrase answer before the end of the preselected time period.

5. A method of playing a game as recited in claim 4, comprising the additional step of awarding the player, who correctly recites the word or phrase answer, points based upon a selected number minus the number of clues given by the starter and multiplied by the number the player rolls on the die.

6. A method of playing a game as recited in claim 1, comprising the additional step of:

reading a second clue to the group of players if the correct word or phrase answer was not recited before the end of the preselected period of time allotted for the first clue.

7. A method of playing a game as recited in claim 6, comprising the additional step of:

initiating the timer for the preselected period of time.

8. A method of playing a game as recited in claim 1, comprising the additional step of:

reading a third clue to the group of players if the correct word or phrase answer was not recited before the end of the preselected period of time allotted for the second clue.

9. A method of playing a game as recited in claim 8, comprising the additional step of:

initiating the timer for the preselected period of time.

10. A method of playing a game comprising the steps of:

a) selecting a group of players to play the game;

b) selecting a starter from the group of selected players to initiate a round;

c) having the starter randomly select a game piece that contains a scrambled alphanumeric character string;

wherein, for each round, the method comprises the steps d) through i) of:

d) allowing the group of players to view the scrambled alphanumeric character string;

e) having the starter read out a first of at least two remaining clues to the group of players;

f) initiating a timer for a preselected period of time;

g) allowing the players to attempt to unscramble the alphanumeric character string into a second alphanumeric character string that phonetically or representatively corresponds to the word or phrase answer;

h) awarding the player who recites the correct word or phrase answer. before the end of the preselected time period, points;

i) subtracting one point from the player who recites a word or phrase that is not the answer; and wherein the game further comprises the steps of:

j ) repeating steps d) through i) for the remaining clues until a player recites a correct answer or the remaining clues are given;

k) repeating steps b) through j) if none of the players recite the correct word or phrase answer after the remaining clues are given; and l) determining a winner to the game, based upon the first player to accumulate a preselected point total.

11. A game, said game comprising:

a plurality of game pieces each having a scrambled alphanumeric character string, an unscrambled alphanumeric character string, a correct word or phase and at least one clue;

said unscrambled alphanumeric character string on the game piece phonetically or representatively corresponds to said correct word or phrase;

at least one unscrambling pad of paper for unscrambling said alphanumeric character string;

a timing device to limit time allotted for a round;

a die; and a scoring pad of paper.

12. A game as recited in claim 11, wherein: the scrambled alphanumeric character string on the game piece is in the form of an automobile license plate.

* * * * *